United States Patent [19]

Bennett

[11] Patent Number: 4,955,513

[45] Date of Patent: Sep. 11, 1990

[54] DISPENSING CLOSURE WITH FLAP RETENTION

[75] Inventor: Kurt K. Bennett, Cuyahoga Falls, Ohio

[73] Assignee: Weatherchem Corporation, Twinsburg, Ohio

[21] Appl. No.: 464,981

[22] Filed: Jan. 16, 1990

[51] Int. Cl.[5] ..... B67D 3/00; A47G 19/24

[52] U.S. Cl. ..... 222/480; 215/235; 215/237; 220/339; 222/556

[58] Field of Search ..... 222/480, 481, 482, 498, 222/545-546, 556, 565; 215/232, 235, 237; 220/254, 307, 339

[56] References Cited

U.S. PATENT DOCUMENTS

| | | | |
|---|---|---|---|
| 3,036,746 | 5/1962 | Hagen | 222/480 |
| 3,140,019 | 7/1964 | Barr | 222/480 |
| 3,155,285 | 11/1964 | Van Baarn | 222/480 X |
| 3,322,308 | 5/1967 | Foster | 222/480 |
| 3,370,757 | 2/1968 | Foster | 222/480 X |
| 3,469,732 | 9/1969 | Foster | 222/480 X |
| 4,177,932 | 12/1979 | Cleevely | 220/254 X |
| 4,291,818 | 9/1981 | Nozawa et al. | 220/339 X |
| 4,693,399 | 9/1987 | Hickman et al. | 215/237 X |
| 4,714,181 | 12/1987 | Kozlowski et al. | 222/556 X |
| 4,723,693 | 2/1988 | DeCoster | 222/545 X |
| 4,881,668 | 11/1989 | Kitterman et al. | 222/565 X |

*Primary Examiner*—Kevin P. Shaver

*Attorney, Agent, or Firm*—Pearne, Gordon, McCoy & Granger

[57] ABSTRACT

An injection-molded plastic dispensing cap providing a semicircular spoon opening through which spoonfuls of the contents of an associated container can be removed. The cap provides a hinged flap for closing the opening which is hinged to the body and movable between an open position and a closed position. The cap provides an inwardly extending lip along the periphery of the opening. A rib is formed on the flap to closely fit the lip along the opening when the flap is in the closed position. Projecting from the rib is a latch projection fitting under the lip to secure the flap in the closed position. The lip is provided with a central recess bridged by the latch projection. The lip and the latch cooperate to provide spaced and opposed latching portions which are relatively insensitive to variations in the torque applying the cap to an associated container and which are not adversely affected by removal of the cap from its mold while the cap is still relatively hot.

5 Claims, 2 Drawing Sheets

DISPENSING CLOSURE WITH FLAP RETENTION

BACKGROUND OF THE INVENTION

This invention relates generally to closures for containers, and more particularly to injection-molded plastic closures with hinged flaps having improved latching means.

PRIOR ART

U.S. Pat. Nos. 4,693,399 and 4,714,181, along with the copending application for Letters patent Ser. No. 07/224,342, filed July 26, 1988, all disclose injection-molded caps for condiment containers of the "shake-and-spoon" type. The caps provide a generally semicircular spoon opening along one side sized so that a spoon can be inserted into the container to remove spoons full of container contents. Along the other side of the cap are a plurality of relatively small apertures for shaking or sifting the container contents. The caps also provide two flaps or closures joined to the cap by a living hinge. One flap functions to selectively open or close the spooning opening and the other flap functions to open or close the shaking apertures. U.S. Pat. No. 4,693,399 and the copending application Ser. No. 07/224,342 are assigned to the assignee of this invention, and both that patent and the pending application are incorporated herein by reference in their entirety.

In order to produce the maximum number of caps during a given period of time from a given mold, it is necessary to reduce the cycle time of the molding operation as much as possible. Consequently, the practice has been to remove the caps from the mold while they are still hot and to cool the caps to ambient temperature outside of the mold.

Proper molding requires that the caps be molded in a flap-open position. In such condition, the caps cannot be conveniently packed for storage and shipment. Therefore, the general practice has been to feed the caps through a flap-closing machine which operates to automatically close the flaps so that they can be packaged in cartons for storage and shipment. In order to expedite the packaging of the caps, the flaps are closed before the caps cool to ambient temperature. At the point of use, the closed caps are supplied to a capping machine which screws them onto the container, such as a container filled with a condiment. The capping machines of different users differ, and may be adjusted in different ways so that some caps are tightly applied and others are more loosely applied. Further, the caps are applied to different types of containers which require different degrees of tightness to form a proper seal.

The caps must provide latching means which reliably operate to retain the flaps in the closed position but which the user can easily release to permit removal of the contents of the container, usually condiments.

In the past, difficulty has been encountered in providing a latching structure which will reliably hold the flaps closed while they cool to ambient temperature or when applied to a container over a wide range of tightness, and which can be easily and repeatedly opened and closed by the user.

In some instances, the latching structure releases if the cap is applied to the container with a high torque. Further, if the cap is applied with low torque, the flaps may be difficult to release in use.

The copending application, supra, discloses and claims a cap which reduces the effect on the latching structure produced by variations in the torque used to apply the cap to the container. A structure is disclosed in which ribs are provided to reduce the deflection variations in the structure associated with the latch closure caused by variations in the torque used in applying the cap. Such cap structure also reduces the effect on the latch structure resulting from applying the cap to different containers. Although the structure of such copending application has substantially improved the insensitivity of the latch structure to variations in application torque and container differences, difficulties are sometimes still encountered, particularly with respect to the latch for the spoon opening closure flap.

SUMMARY OF THE INVENTION

The present invention provides an improved latch structure for hinged flaps provided with injection-molded container closures. With the present invention, a latch structure is provided which reliably operates to hold the associated cap closed while it cools to ambient temperature and which can be easily opened and closed by the user even when the cap is applied to a variety of containers with a torque which varies over a substantial range of values.

In the illustrated embodiment of this invention, the latch for the spoon opening flap of the copending application, supra, is modified to provide a recess in the latch structure at its center. This results in a latch structure in which two separate similar and opposed latches are provided with one on each side of the centerline of the flap.

Specifically, the body of the cap is provided with a semicircular opening through which a spoon may be inserted into the container when the associated flap is open. An inwardly extending lip is provided along the semicircular portion of the opening except for a small distance along the middle of the semicircular portion where the lip is interrupted or discontinued to provide the recess.

The associated flap is connected to the cap body along the rearward edge of the opening by a living hinge. The underside of the flap is provided with a semicircular rib extending down into the opening, closely fitting the lip along the semicircular portion of the opening, to provide a very small clearance through which the contents cannot pass. In effect, the lip and rib provide a seal with respect to the opening. The flap also extends beyond the rib to overlay the adjacent surface of the cap body when in its closed position.

Adjacent to the center of the flap rib a radially extending latch portion is provided which engages and locks onto the lip along both sides of the recess therein. This latching structure is not discontinued in the center portion where the lip is interrupted by the recess and at least partially covers the recess to reduce the tendency for leakage to occur through the recess. Also, a dual latching structure is provided with one latch structure on each side of the centerline of the flap.

When in use, the flap is opened by the user by applying a force along the centerline between the two separate latches. The amount of force required to cause release of the latches tends to remain relatively constant even when the cap is applied to a container with a relatively wide range of torques or is applied to a variety of containers. Further, the illustrated structure functions with improved reliability when the flaps are closed while the cap is still quite hot, and its operation is not adversely affected by shrinkage or the like which occurs as the cap continues to cool.

These and other aspects of this invention are illustrated in the accompanying drawings, and are more fully described in the following specification.

DETAILED DESCRIPTION OF THE DRAWINGS

Figure 1:
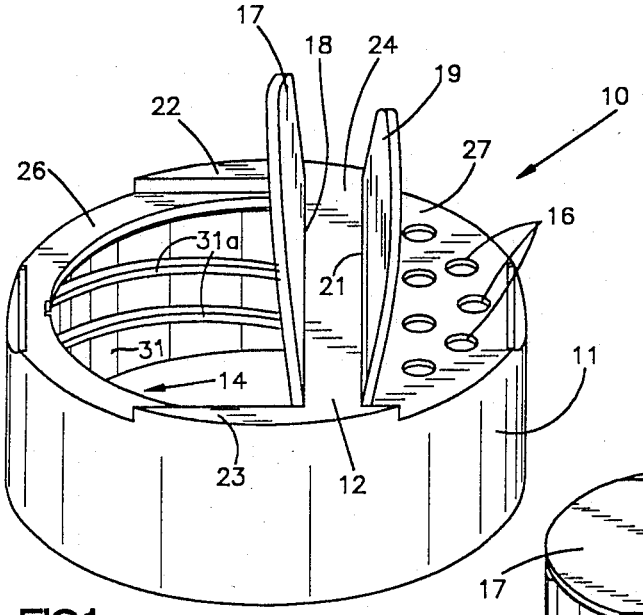
FIG. 1 is a perspective view of a cap in accordance with the present invention, illustrated with both of the flaps in the open position.

FIG. 1 illustrates the overall arrangement of the illustrated embodiment of a closure cap 10 in accordance with the present invention. The illustrated cap is a one-piece injection-molded body providing a cylindrical skirt 11 and a circular end wall 12. The cap, when in use, is threaded onto a mouth of a container 13, illustrated in FIG. 6.

The illustrated embodiment is a shake-and-spoon type cap often used with containers of spices or other condiments. The end wall is formed with an enlarged, generally semicircular spooning opening 14 along one side and a plurality of relatively small shaker apertures 16 along the other side. A first hinged flap 17 is integrally formed as part of the body of the cap 10 and is connected by a living hinge for pivotal movement along a hinge line 18. The flap 17 is pivotally movable between an open position, illustrated in FIG. 1, and a closed position, illustrated in FIG. 1*a*, in which it tightly closes the spooning opening 14.

A latching structure (discussed in detail below) is provided to latch the first flap 17 in its closed position and which is releasable to allow the flap to be pivoted to the open position illustrated in FIG. 1 so that a spoon can be inserted through the opening 14 into the associated container to remove spoonfuls of the contents from the container.

A second flap 19, also integrally formed with the body of the cap 10, is connected to the end wall 12 for pivotal movement about a living hinge extending along the hinge line 21. The second flap is pivotally movable between an open position illustrated in FIG. 1 and a closed position illustrated in FIG. 1*a*, in which it closes and seals the shaker apertures 16. Here again, a latching structure is provided to releasably secure the second flap in its closed position.

Figure 1A:
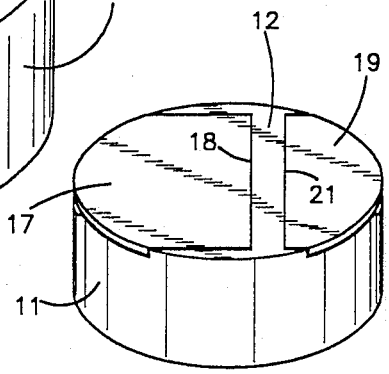
FIG. 1*a* is a perspective view of the cap with the flaps in their closed position.

The end wall 12 is contoured so that when the two flaps 17 and 19 are closed, the end wall cooperates with the flaps to provide a planar or flat, circular exposed surface, as illustrated in FIG. 1*a*. To accomplish this, the end wall is provided with laterally opposed, upwardly projecting portions 22 and 23 which are flush with a hinge support portion 24. Adjacent to the spooning opening 14, the end wall is provided with a first recessed portion 26 having an upper surface positioned below the surface of the projecting portions 22 and 23 an amount equal to the thickness of the first flap 17. Therefore, the exposed surface of the flap 17 is coplanar with the surface of the projecting portions 22 and 23 and with the surface of the hinge support portion 24 when the flap is in its closed position.

Similarly, a second recessed portion 27, in which the shaker apertures 16 are formed, is recessed below the surface of the projecting portions 22 and 23 by a distance equal to the thickness of the flap 19. Therefore, when the second flap is in its closed position, the exposed surface thereof is flush with the surface of the projecting portions 22 and 23 and the hinge support portion 24 to cooperate with these surfaces and the exposed surface of the first flap 17 to provide a smooth, planar, exposed surface when the two flaps are closed.

The interior wall 31 of the skirt 11 is generally cylindrical but is provided with inwardly extending helical thread projections 31*a* positioned in size to mate with the exterior or male threads adjacent to the mouth of the container 13.

The cap 10 is molded from thermoplastic material by injection molding into a mold cavity of a type known to those skilled in the art. The thermoplastic material is heated to a fluid state prior to injection into the mold and is retained in the mold until it cools a sufficient amount to solidify and hold its shape.

Figure 6:
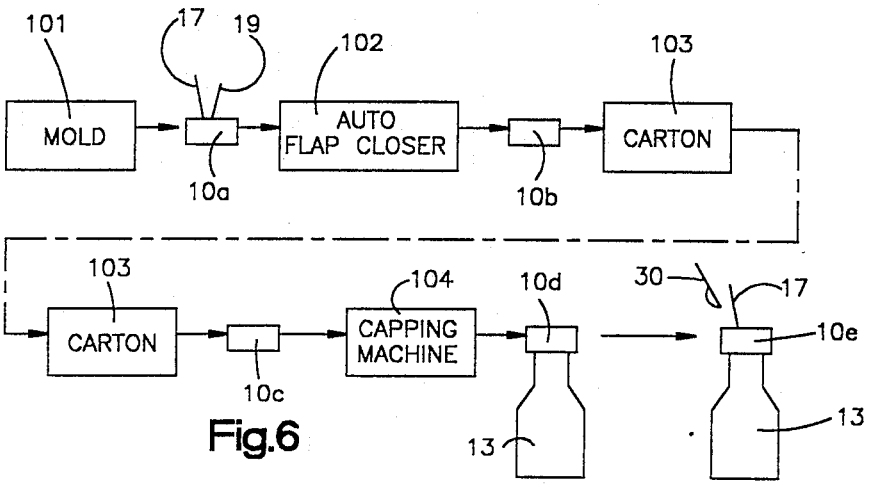
FIG. 6 schematically illustrates the sequence of operations during manufacture, application, and use of a cap in accordance with the present invention.

FIG. 6 schematically illustrates the various steps or operations involved in the manufacture of the caps to the point where the caps are installed on the containers 13 and the flap 17 is open to allow removal of the contents from the container 13 with a spoon 30.

In order to maximize the production obtainable from a given mold 101, the caps 10 are removed from the mold as soon as the material forming the caps cools a sufficient amount to maintain stability. The cap 10*a* is therefore still quite hot and, as it continues to cool, some further shrinkage occurs. When the cap 10*a* is removed from the mold 101, the two flaps 17 and 19 are in an open position. Before packaging the caps, they are passed through an automatic flap closer 102 which moves the two flaps to their closed position as illustrated in FIG. 6 at 10*b*. The caps are then arranged in cartons 103 for storage and shipment.

When the cartons of caps are received by the producer of the material which is placed in the containers 13, such as spices or condiments, the caps are removed from the cartons 103 while the flaps are in the closed position, as illustrated at 10*c*, and supplied to capping machines 104, which apply the caps to the containers 13 filled with the condiments or the like, as illustrated at 10*d*. Thereafter, when the purchaser desires to remove some of the contents from the container 13, the flap 17 or the flap 19 can be opened. In the event the cap 17 is opened by the purchaser, a spoon can be inserted into the opening 14 to remove spoonfuls of content from the container 13, as illustrated at 10*e*.

In some instances, a paper or foil-like seal is placed on the mouth of the container 13 prior to the installation of the cap 10. Such seal is used when it is necessary to provide a completely airtight closure to protect the contents until the purchaser is ready to remove the contents from the container. In such instances, the cap 10 is removed from the container so that the foil or paper seal can be removed from the mouth of the container 13, after which the cap 10 is reinstalled on the container for typical dispensing of the contents thereof.

In other instances in which an airtight seal is not required to preserve the contents of the containers 13, the cap may be applied directly to the container on which a seal has not been previously installed and the cap then provides a total closure for the container. In either event, it is important that the cap be structured so that the contents of the container, usually a granular or powdered material, cannot spill out into the zone under the flaps when the container is inverted, either during shipment or in use when the purchaser uses it as a shaker. It is also important that the flaps remain fully latched and closed after they leave the automatic flap closer 10 until the purchaser opens one or the other of the flaps to allow dispensing of the contents of the container. Further, it is important also that the flaps can be easily opened and closed by the purchaser.

Figure 4:
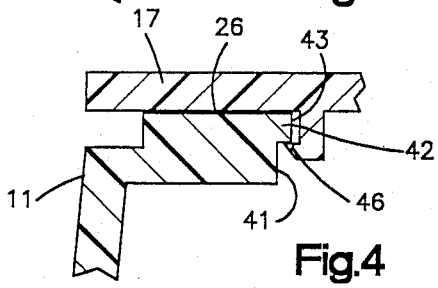
FIG. 4 is an enlarged fragmentary section taken along line 4—4 of FIG. 2*a;*

Referring now to FIGS. 2 through 5, the spoon opening 14 is substantially semicircular in shape as it extends from the hinge line 18 and provides an inwardly facing, axially extending surface 41 along the periphery of the opening 14. Extending inwardly from such surface 41 is an inwardly extending lip 42 or step which provides an inwardly facing, narrow surface 43 (best illustrated in FIGS. 3 and 4). The flap 17 is formed with a downwardly facing rib 44 along its underside which closely fits the surface 43 of the lip 42. Extending radially outward from the rib 44 is a latch projection 46 which snaps under the lip 42 to lock the flap 17 in the closed position, as illustrated in FIG. 4. The rib and latch are sized so that when an upward force is applied to the flap to open the flap, the latch and rib deflect a sufficient amount for the latch to move out of the latched position and allow the flap to be opened. Conversely, when the flap is to be closed, the underside of the latch 46 is beveled so that it is cammed inwardly until it snaps into the latched position illustrated in FIG. 4.

Figure 2:
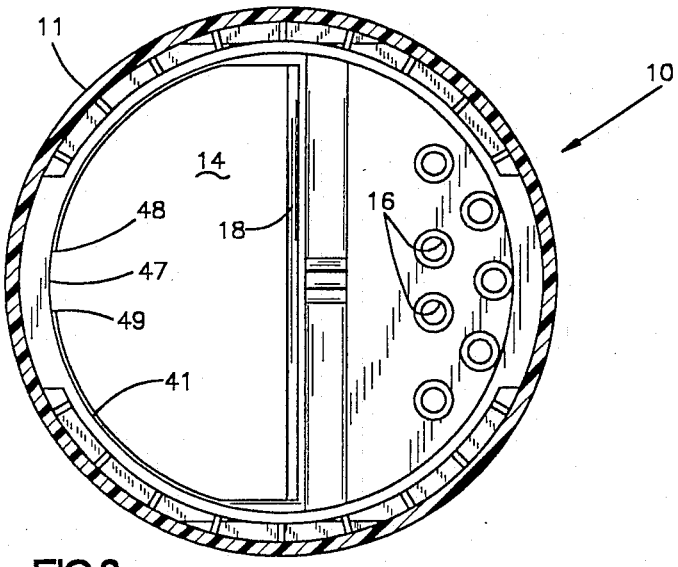
FIG. 2 is a bottom view of the cap with the spoon flap in the open position, illustrating the lip which extends along the semicircular portion of the spoon opening and the location of the recess formed in such lip along the centerline of the opening.
Figure 2A:
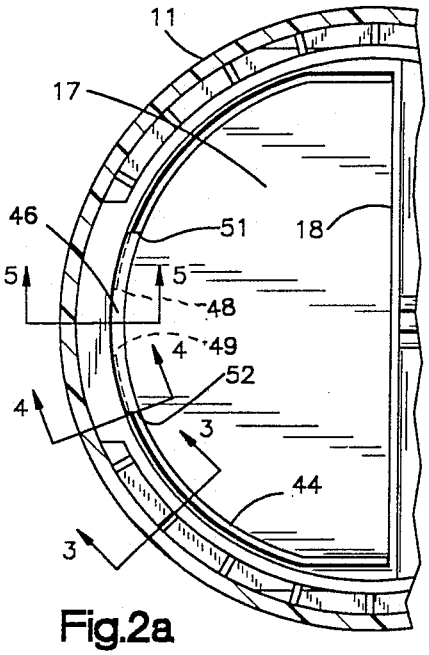
FIG. 2*a* is a fragmentary view similar to FIG. 2, but illustrating the spoon opening flap in its closed and latched position.
Figure 3:
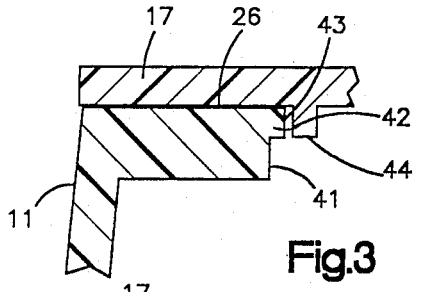
FIG. 3 is an enlarged, fragmentary section taken along line 3—3 of FIG. 2*a;*

The structure thus far described is identical to the structure disclosed in the copending application, Ser. No. 07/224,342, supra. In accordance with the present invention, however, the lip 42 is interrupted along the centerline of the opening to provide a recess 47, best illustrated in FIG. 2. Such recess extends from the point 48 to the point 49 along the surface 41. As best illustrated in FIG. 2*a*, the latch 46 extends from the point 51 to the point 52 so that the lip 42 and the latch projection 46 cooperate to provide two spaced and opposite latching structures, with one on each side of the recess 47.

It has been found that such a latching structure provides a more reliable latch which is capable of retaining the flap 17 in its closed position even when the cap is hot, having been removed from the mold before it cools completely to ambient temperature. Such latch also reliably functions when the cap is applied to different types of containers with different degrees of tightness. However, even though the latch functions reliably under such conditions, this improved latch can be consistently opened and closed by the purchaser without requiring excessive forces. Since the opening force is generally applied along the centerline and in alignment with the recess, it tends to concentrate the opening force at the inner edges of the two latches. The opening force, therefore, is more effective in commencing release of the latches.

With the structure in accordance with the present invention, the inwardly facing surface 43 on the lip cooperates with the exterior surface of the rib 44 to prevent the passage of any content material from the container when the flap is closed except along the zone of the recess 47. This face-to-face adjacency of these two surfaces to prevent passage of the contents of the containers 13 is desirable, since a completely reliable closure seal cannot be provided between the planar surface of the recess 26 and the undersurface of the flap, due to varying degrees of shrinkage which occur along such surfaces to prevent good mating contact. On the other hand, the very close face-to-face adjacency between the inwardly facing surface 43 and the outer surface of the rib 44 can be reliably maintained.

Figure 5:
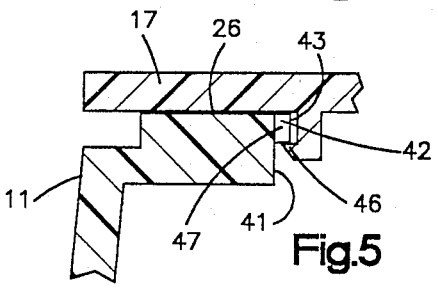
FIG. 5 is an enlarged, fragmentary section taken along line 5—5 of FIG. 2*a*.

As best illustrated in FIG. 5, however, where the recess is formed by an interruption in the lip 42, such face-to-face adjacency is not provided by the outer surface of the rib. However, a good seal is maintained because the latch projection 46 bridges the recess and partially covers the recess to reduce the possibility of flow of the container contents through the recess. With the present invention, a reliable latching system is provided in which two spaced and opposite latches securely hold the flap 17 in the closed position but permit relatively easy opening and closing of the flap when the purchaser wishes to spoon contents of the containers 13 through the spoon opening 14.

With the present invention, a cap is provided having flaps which function reliably and which can be easily opened and closed. Further, the flaps form a very effective seal when closed to prevent loss of container content material even when the container is inverted.

Although the preferred embodiment of this invention has been shown and described, it should be understood that various modifications and rearrangements of the parts may be resorted to without departing from the scope of the invention as disclosed and claimed herein.

What is claimed is:

1. A dispensing cap for containers comprising an injection-molded plastic one-piece body providing a circular end wall and a cylindrical skirt extending from one side of said end wall, said end wall providing at least one opening through which contents from an associated container can be removed without removing said cap from said associated container, said body providing a flap connected to said end wall by hinge means, said flap being pivotable from an open position in which said opening provides access to said associated container and a closed position closing said opening, said end wall providing an inwardly extending lip bordering said opening along portions thereof spaced from said hinge means and providing an inwardly facing inner first surface, said lip being interrupted along a recessed central portion to provide a central radially extending recess, said flap providing an outwardly facing second surface positioned in close face-to-face adjacency with said first surface when said flap is in said closed position and cooperating therewith to provide a seal preventing passage of contents of said associated container, and a radially extending latch adjacent said second surface which extends under said lip to releasably lock said flap in said closed position, said latch extending uninterrupted past said recessed central portion, whereby said latch is substantially unaffected by shrinkage of the plastic forming said cap and variations in tightness of said cap on a container.

2. A dispensing cap as set forth in claim 1, wherein the portion of said latch extending past said recess partially closes said recess to continue said seal past said recess.

3. A dispensing cap as set forth in claim 2, wherein said second surface is provided by a rib extending laterally from the bottom surface of said flap.

4. A dispensing cap as set forth in claim 3, wherein said cap is formed of injection-molded thermoplastic material and is molded with said flap in said open position, and said flap is closed and latched before said thermoplastic material cools to substantially ambient temperature.

5. A dispensing cap as set forth in claim 4, wherein said cap further includes shaker apertures and a second flap for closing said shaker apertures.

* * * * *